United States Patent [19]

Porsche et al.

[11] 4,183,206

[45] Jan. 15, 1980

[54] PORTABLE WATCH, ESPECIALLY WRISTWATCH

[75] Inventors: Ferdinand A. Porsche, Stuttgart; Jan Matthias, Gries, both of Fed. Rep. of Germany

[73] Assignee: Ferdinand Alexander Porsche, Fed. Rep. of Germany

[21] Appl. No.: 845,654

[22] Filed: Oct. 26, 1977

Related U.S. Application Data

[63] Continuation-in-part of Ser. No. 833,992, Sep. 16, 1977, abandoned.

[30] Foreign Application Priority Data

Sep. 16, 1976 [DE] Fed. Rep. of Germany ..... 2641651

[51] Int. Cl.[2] ..... G04B 47/06

[52] U.S. Cl. ..... 58/152 C; 58/88 E

[58] Field of Search ..... 58/152 G, 152 R, 152 C, 58/88 R, 88 E, 53, 103; 33/33 S

[56] References Cited

U.S. PATENT DOCUMENTS 1,355,343 10/1920 Korn ..... 58/152 C

FOREIGN PATENT DOCUMENTS 485778 9/1972 Australia ..... 33/355

585929 3/1977 Switzerland ..... 58/152 R

*Primary Examiner*—J. V. Truhe

*Assistant Examiner*—Leonard W. Pojunas, Jr.

*Attorney, Agent, or Firm*—Craig and Antonelli

[57] ABSTRACT

A portable watch and compass device is provided which has a separate housing for the watch and compass. The housing for the watch is arranged above the compass housing and is movable about a hinge axis extending parallel to the longitudinal extent of a person's arm wearing the watch as a wristwatch. With the housings arranged one above the other and separately from one another, and with the further provision of a mirror at the underside of the watch housing, the watch housing can be selectively hingedly moved to an adjusted open and locked position to accommodate convenient reading of the compass without interference by the watch face characters and the like.

7 Claims, 5 Drawing Figures

PORTABLE WATCH, ESPECIALLY WRISTWATCH

BACKGROUND AND SUMMARY OF THE INVENTION

This is a continuation-in-part application of our application Ser. No. 833,992 filed Sept. 16, 1977, abandoned titled PORTABLE WATCH, ESPECIALLY WRISTWATCH, and based on German Application Number P 26 41 651.3, filed Sept. 16, 1976 in Germany.

The invention relates to a portable watch, especially a wristwatch, provided with a compass.

With a known watch of the type mentioned at the outset (DT-AS 1 085 101), the compass and the watch is placed in a single housing. The compass needle is thereby supported on a pin above the hand support shaft of the watch. This arrangement has the disadvantage that the exact reading of the two instruments is made difficult as a result of the superimposition of the watch hand and the compass needle.

It is an object of the invention to provide a portable watch with a compass in which the mentioned disadvantage is avoided. In preferred embodiments, auxiliary systems such as mirror, sighting device or the like for the operation of the compass are also favorably arranged.

According to an important feature of the invention, the above-noted problems of the prior arrangement are solved by providing that the watch and the compass are accommodated in separate housings arranged one above the other whereby the upper housing is adjustable in relation to the lower housing. In the most preferred embodiments, the watch is advantageously provided in the upper housing and the compass in the lower housing. In such preferred embodiments, the upper housing is adjustably movable with respect to the lower housing about a hinge-joint. The pivot or swinging axle of the hinge-joint extends essentially in the longitudinal direction of the arm of the person wearing the watch. At the side of the upper housing which faces the lower housing, a mirror for the control and reading of the compass needle and compass scale is provided. A sighting device for aligning the compass needle is provided which consists of a sight and notch provided at the lower housing. Further, a measuring scale is provided at the lower housing in certain preferred embodiments. The two housings are preferably held in their folded positions by means of a clamp lock.

The advantages, especially obtained with the invention are seen therein, that each instrument is readable and operable by itself without interference from the other. The arrangement of the housing with the compass below and the watch above was selected for the reason that the watch is quite likely to be utilized much more often than the compass. The hinge-joint accommodates a simple fold-open movement of the watch which leads to an easy access to the compass. In addition, by the arrangement, in preferred embodiments, of a mirror and the sighting device at the upper housing, all auxiliary systems, required for the operation of the compass, are attached.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
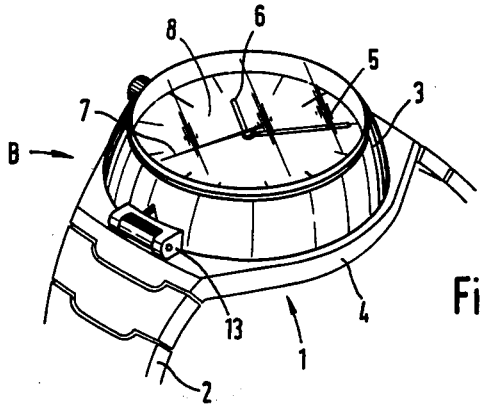
FIG. 1 is a perspective view of a wristwatch with compass constructed in accordance with a preferred embodiment of the present invention.

The watch 1 is constructed so that it can be worn on the human wrist and comprises an armband 2 (shown partially) as well as two housings 3 and 4 arranged one above the other. A watch works, not shown in detail, is provided in the upper housing 3 and has watch hands 5, 6, 7. Hands 5, 6, 7 are covered by a crystal or pane 8. The lower housing receives a compass 9 provided with a compass needle 10 and a scale 11. The compass needle 10 is also covered by a crystal or pane 12.

Figure 2:
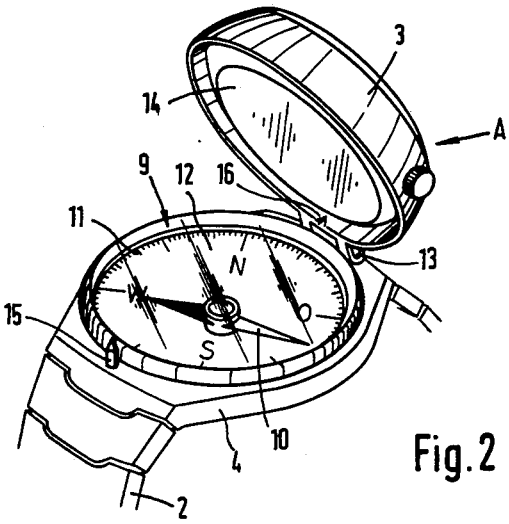
FIG. 2 is a view corresponding to FIG. 1, however with the wristwatch turned by 180° and with the watch housing opened to accommodate reading of the compass.
Figure 4:
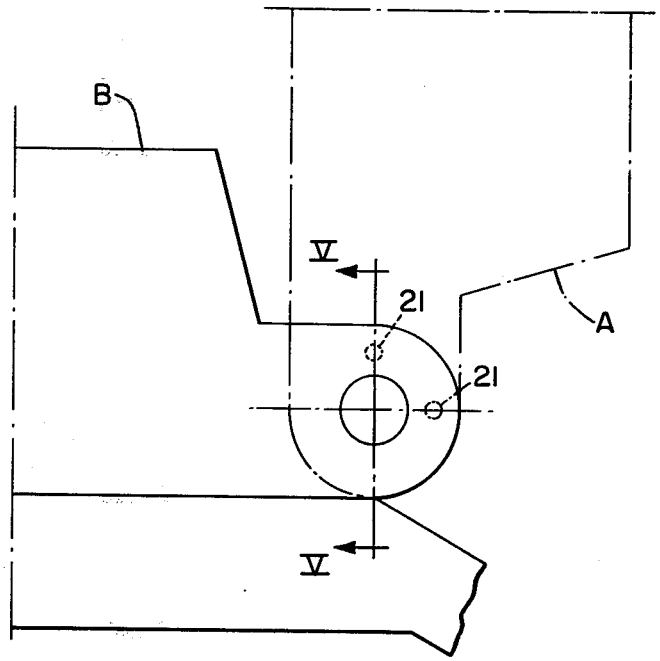
FIG. 4 is an enlarged schematic view, taken in the direction of arrow C in FIG. 1, showing details of a mechanism for holding the upper and lower housing in a predetermined position.
Figure 5:
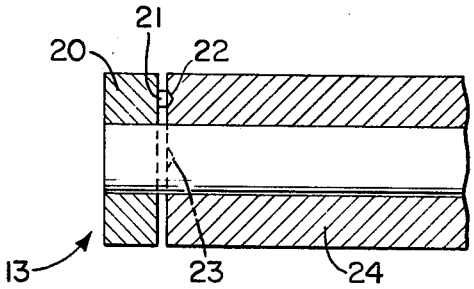
FIG. 5 is a sectional view taken along line V—V of FIG. 4.

The upper housing 3 is constructed adjustable in relation to the lower housing 4 by means of a hinge-joint 13. The hinge-joint 13, the hinge axis of which extends essentially parallel to the arm of the person wearing the watch, is provided with self-locking means of such construction that the upper housing 3 remains in a selected position, for example, position A in FIG. 2. FIGS. 4 and 5 show such a self-locking means with enlargement detents 21 of rotating part 20 of hinge 13, which detents 21, in dependence on the positions A or B, cooperate with detents 22, 23 on fixed part 24 to hold the parts in relative rotative positions. In addition, a clasp-lock is preferably provided between the two housings 3 and 4 which counteracts an undesired opening of the upper housing 3, thereby retaining housing 3 in its locked position B of FIG. 1.

A mirror 14 is provided on the side of the upper housing 3 facing the lower housing 4, which mirror serves for the control (reading) of compass needle 9 and compass scale 10.

In addition, the compass 8 is provided with a sighting device formed by a gun sight 15 at the lower housing 4 and a notch 16 at the upper housing 3. The gun sight 15 may be further developed for example, to form a clasp lock for locking the housings in the closed position.

Figure 3:
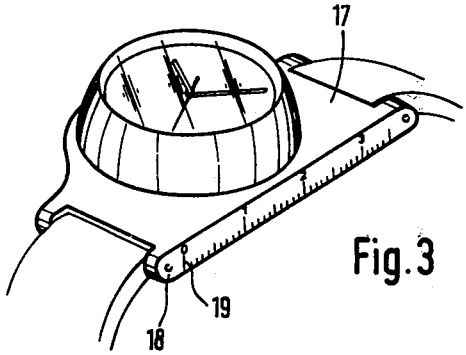
FIG. 3 is a view similar to FIG. 1, but showing another preferred embodiment of the invention.

According to FIG. 3, a straight-extending wall section 18 is provided at the lower housing 17 with a measuring range scale 19. Since other features of this FIG. 3 embodiment are similar to those described above for the embodiment of FIGS. 1 and 2, such other features are not illustrated and described.

While we have shown and described various embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Portable watch and compass apparatus comprising:

a first housing, a watch housed in said first housing, a second housing separate from said first housing, and a compass housed in said second housing, said housings being arranged one above the other with the upper of said housings being adjustably movable with respect to the other housing to accommodate viewing of the one of the watch and compass in said other housing, wherein a sighting device is provided for said compass, said sighting device including a gun sight and a notch at respective opposite sides of a viewing crystal covering the compass, and wherein portions of said gun sight serve simultaneously as a latch part for latching said upper housing at said lower housing with said upper housing obscuring the view of the compass.

2. Apparatus according to claim 1, wherein said first housing is said upper housing and said second housing is said lower housing.

3. Apparatus according to claim 1, wherein said upper housing is supported at the lower housing by means of a hinge-joint.

4. Apparatus according to claim 3, further comprising arm band means attached to the lower housing for supporting the same on a human wrist, wherein said hinge-joint exhibits a hinge axis extending in the longitudinal direction of the arm of a person wearing the apparatus.

5. Apparatus according to claim 2, wherein said upper housing is supported at the lower housing by means of a hinge-joint.

6. Apparatus according to claim 5, wherein a mirror is provided at the side of the upper housing which faces said lower housing, said mirror being configured to accommodate control and reading of the position of a compass needle and compass scale of the compass in said lower housing.

7. Apparatus according to claim 2, wherein a measuring scale is provided along one edge of the lower housing.

* * * * *